US006935280B1

(12) United States Patent
Scott et al.

(10) Patent No.: US 6,935,280 B1
(45) Date of Patent: Aug. 30, 2005

(54) COLD WATER INLET FOR REDUCING ACCUMULATION OF SCALE

(75) Inventors: Timothy D. Scott, Battle Creek, MI (US); Michael Gordon, East Grand Rapids, MI (US); Christopher P. Stafford, Hastings, MI (US); Darrell Rodriguez, Lake Odessa, MI (US)

(73) Assignee: Bradford White Corporation, Ambler, PA (US)

( * ) Notice: Subject to any disclaimer, the term of this patent is extended or adjusted under 35 U.S.C. 154(b) by 0 days.

(21) Appl. No.: 10/943,420

(22) Filed: Sep. 17, 2004

(51) Int. Cl.[7] ..... F22B 37/48
(52) U.S. Cl. ..... 122/14.3; 122/383; 122/13.3
(58) Field of Search ..... 122/14.3, 13.01, 122/13.3, 379, 380, 381, 383

(56) References Cited

U.S. PATENT DOCUMENTS

| | | | | |
|---|---|---|---|---|
| 1,790,357 | A | | 1/1931 | Stack |
| 2,123,809 | A | | 7/1938 | Seitz |
| 2,592,863 | A | | 4/1952 | Conner |
| 2,602,465 | A | | 7/1952 | Goehring |
| 2,766,200 | A | | 10/1956 | Kaufman |
| 2,809,267 | A | | 10/1957 | Schauer, Jr. |
| 2,825,464 | A | | 3/1958 | Mack |
| 3,229,683 | A | | 1/1966 | Russell et al. |
| 3,285,241 | A | | 11/1966 | Bordeaux |
| 3,465,123 | A | | 9/1969 | Harris |
| 3,726,475 | A | | 4/1973 | Elsing |
| 3,762,395 | A | | 10/1973 | Taylor |
| 3,776,456 | A | | 12/1973 | Eising |
| D241,360 | S | | 9/1976 | Scozzafava |
| 4,083,583 | A | | 4/1978 | Volgstadt et al. |
| 4,157,077 | A | | 6/1979 | Lindahl |
| 4,206,779 | A | | 6/1980 | Sandstrom |
| 4,216,092 | A | | 8/1980 | Shalhoob et al. |
| 4,257,355 | A | * | 3/1981 | Cook ..... 122/18.31 |
| 4,263,879 | A | | 4/1981 | Lindahl |
| 4,332,401 | A | | 6/1982 | Stephenson et al. |
| 4,340,245 | A | | 7/1982 | Stalder |
| 4,398,754 | A | | 8/1983 | Caroleo et al. |
| 4,505,231 | A | | 3/1985 | Syler |
| 4,512,289 | A | | 4/1985 | Collins |
| 4,549,525 | A | | 10/1985 | Narang |

(Continued)

FOREIGN PATENT DOCUMENTS

| | | |
|---|---|---|
| AU | 17117/76 | 3/1978 |

(Continued)

*Primary Examiner*—Gregory Wilson
(74) *Attorney, Agent, or Firm*—RatnerPrestia

(57) ABSTRACT

A cold water inlet for a tank of a water heater is provided. The inlet includes an inlet conduit configured to extend toward a flue extending upwardly through the tank. The inlet conduit includes a proximal, intermediate, and distal conduit portion, the distal portion terminating at a closed end configured to reduce the amount of the water flow directed toward the flue. The cold water inlet further includes flow openings defined in the distal portion to permit the water flow to exit the inlet conduit. Deflectors are positioned along the distal portion proximal respective ones of the flow openings, and are oriented for deflecting the water flow. The closed end and the deflectors of the inlet conduit coact, as the water flows into the tank, to direct the water flow away from the flue and toward the side wall and bottom of the tank, thereby reducing an accumulation of scale.

23 Claims, 5 Drawing Sheets

U.S. PATENT DOCUMENTS

| | | | | |
|---|---|---|---|---|
| 4,662,314 | A | | 5/1987 | Moore, Jr. |
| 4,714,053 | A | | 12/1987 | Perry |
| 4,735,174 | A | | 4/1988 | Crump |
| 4,790,289 | A | | 12/1988 | Barrett |
| 4,790,291 | A | | 12/1988 | Barrett |
| 4,813,383 | A | | 3/1989 | Daugirda |
| 4,817,564 | A | | 4/1989 | Akkala et al. |
| 4,838,211 | A | | 6/1989 | Vago |
| 4,854,613 | A | | 8/1989 | Reece et al. |
| 4,858,563 | A | | 8/1989 | Perry |
| 4,870,927 | A | | 10/1989 | Sundheimer |
| 4,898,124 | A | | 2/1990 | Granberg et al. |
| 4,898,150 | A | | 2/1990 | Lewis |
| 4,905,900 | A | | 3/1990 | Scharton et al. |
| 4,911,108 | A | | 3/1990 | Akkala et al. |
| 4,949,680 | A | | 8/1990 | Kale |
| 4,951,614 | A | | 8/1990 | Akkala et al. |
| 4,964,394 | A | | 10/1990 | Threatt |
| 4,972,804 | A | | 11/1990 | Stolmar |
| 5,054,437 | A | | 10/1991 | Kale |
| 5,092,279 | A | | 3/1992 | Barmore |
| 5,137,053 | A | | 8/1992 | Kale |
| 5,152,843 | A | | 10/1992 | McDonald et al. |
| 5,169,180 | A | | 12/1992 | Villoni et al. |
| 5,222,770 | A | | 6/1993 | Helevirta |
| 5,277,171 | A | | 1/1994 | Lannes |
| D349,046 | S | | 7/1994 | Brown |
| 5,341,770 | A | * | 8/1994 | Lannes ..... 122/383 |
| 5,348,779 | A | | 9/1994 | Igarashi |
| 5,365,891 | A | | 11/1994 | Hanning |
| 5,671,771 | A | | 9/1997 | Brandel |
| 5,943,984 | A | * | 8/1999 | Lannes ..... 122/392 |
| 5,988,117 | A | * | 11/1999 | Lannes ..... 122/383 |
| 6,129,121 | A | | 10/2000 | Kohle |
| 6,138,614 | A | * | 10/2000 | Shropshire ..... 122/13.3 |
| 6,199,515 | B1 | | 3/2001 | Clarke |
| 6,267,085 | B1 | * | 7/2001 | Alphs ..... 122/13.3 |
| 6,295,411 | B1 | | 9/2001 | Fastman |
| 6,390,029 | B2 | | 5/2002 | Alphs |
| 6,422,606 | B1 | | 7/2002 | Halstead |
| 6,508,208 | B1 | | 1/2003 | Frasure et al. |
| 6,510,819 | B1 | | 1/2003 | Pollock et al. |
| 6,553,947 | B2 | | 4/2003 | Bradenbaugh |
| 2002/0185867 | A1 | | 12/2002 | Stachowiak |

FOREIGN PATENT DOCUMENTS

| | | |
|---|---|---|
| DE | G 90 07 155.7 | 10/1990 |
| EP | 0 132 112 | 1/1985 |
| FR | 2.183.339 | 12/1973 |

* cited by examiner

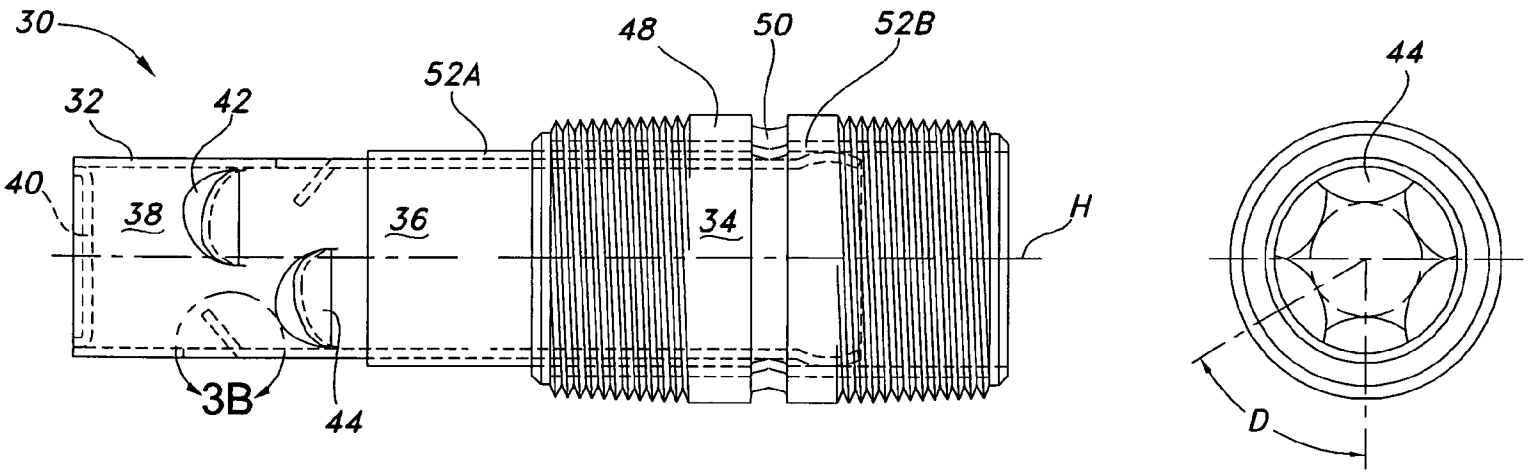
FIG. 3A
FIG. 3C
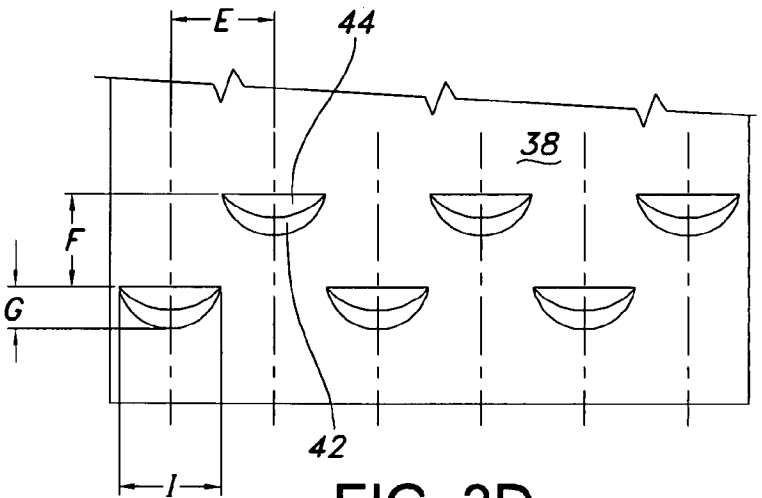
FIG. 3D
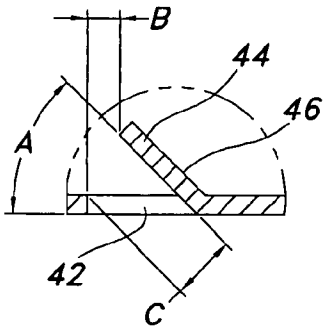
FIG. 3B

COLD WATER INLET FOR REDUCING ACCUMULATION OF SCALE

FIELD OF THE INVENTION

This invention relates to an inlet for a water heater, and more particularly, to a cold water inlet adapted to reduce the accumulation of scale within the water heater.

BACKGROUND OF THE INVENTION

Heating of water promotes the precipitation of sediment. Accumulated sediment tends to harden, forming a scale on various tank surfaces, which reduces water heater efficiency and, in some cases, can lead to failure.

Various inlets have been proposed over the years in an attempt to overcome one or more of these problems. U.S. Pat. No. 4,257,355 to Cook describes a cold water inlet tube with several nozzles to provide jet-like discharges of incoming cold water downwardly at an angle in the general direction of the tank's bottom. A nozzle is also provided at the top of the inlet tube to discharge a jet of cold water upwardly toward the hot water stored in the upper portion of the tank. The angular nozzles in the bottom of the tube are intended to agitate any sediment tending to be deposited on the tank's bottom while the upwardly directed nozzle is intended to reduce stacking.

U.S. Pat. No. 5,943,984 to Lannes discloses an inlet for delivering water into a water heater through a port in its side. The inlet includes a conduit having a distal portion that extends toward a bottom of the water heater.

Nevertheless, there remains a demand for improved cold water inlets.

SUMMARY OF THE INVENTION

In one exemplary embodiment, this invention provides a cold water inlet for delivering water into a water tank of a water heater. The water tank has a side wall, a tank bottom, and at least one flue extending upwardly through the water tank. The cold water inlet includes an inlet conduit configured to extend along a horizontal axis through the side wall of the water tank, into a bottom portion of the water tank, and toward the flue. The inlet conduit includes a proximal conduit portion defining a flow opening for water flow into the inlet conduit, an intermediate conduit portion extending from the proximal conduit portion and defining a flow passage for the water flow, and a distal conduit portion extending from the intermediate portion and terminating at a closed end configured to reduce the amount of the water flow directed toward the flue. The cold water inlet further includes flow openings defined in the distal conduit portion to permit the water flow to exit the inlet conduit. The flow openings are spaced about a circumference of the inlet conduit, thereby eliminating the need to align the inlet conduit with respect to the tank bottom. Deflectors are positioned along the distal conduit portion of the inlet conduit proximal respective ones of the flow openings. The deflectors are oriented to extend distally from the inlet conduit and toward the horizontal axis for deflecting the water flow. The closed end and the deflectors of the inlet conduit coact, as the water flows into the water tank, to direct the water flow away from the flue and toward the side wall and tank bottom of the water tank, thereby reducing an accumulation of scale on the side wall and tank bottom.

In another exemplary embodiment, a water heater is provided including a water tank having a side wall and a tank bottom, at least one flue extending upwardly through an interior of the water tank, and a cold water inlet coupled to the side wall of the water tank for delivering water into the water tank. The cold water inlet includes an inlet conduit extending along a horizontal axis through the side wall of the water tank, into a bottom portion of the water tank, and toward the flue. The inlet conduit includes a proximal conduit portion defining a flow opening for water flow into the inlet conduit, an intermediate conduit portion extending from the proximal conduit portion and defining a flow passage for the water flow, and a distal conduit portion extending from the intermediate portion and terminating at a closed end configured to reduce the amount of the water flow directed toward the flue. The cold water inlet further includes flow openings defined in the distal conduit portion to permit the water flow to exit the inlet conduit. The flow openings are spaced about a circumference of the inlet conduit, thereby eliminating the need to align the inlet conduit with respect to the tank bottom. Deflectors are positioned along the distal conduit portion of the inlet conduit proximal respective ones of the flow openings. The deflectors are oriented to extend distally from the inlet conduit and toward the horizontal axis for deflecting the water flow. The closed end and the deflectors of the inlet conduit coact, as the water flows into the water tank, to direct the water flow away from the flue and toward the side wall and the tank bottom of the water tank, thereby reducing an accumulation of scale on the side wall and the tank bottom.

In yet another exemplary embodiment, a method is provided for delivering cold water into a water heater tank having a side wall, a tank bottom, a cold water inlet, and at least one flue extending upwardly through an interior of the water tank. The method delivers cold water into the water heater tank while reducing the amount of water flow directed toward the flue, eliminating the need to align the cold water inlet with respect to the tank bottom, and directing water flow toward the side wall and the tank bottom to reduce an accumulation of scale on the side wall and the tank bottom. Water is delivered through an inlet conduit along a horizontal axis through the side wall of the water tank, into a bottom portion of the water tank, and toward the flue. Water flow is substantially prevented from the inlet conduit along the horizontal axis toward the flue, thereby reducing the amount of water flow directed toward the flue. Water flow is delivered from the inlet conduit through flow openings defined in the inlet conduit and spaced about a circumference of the inlet conduit, thereby eliminating the need to align the inlet conduit with respect to the tank bottom. Water flow is deflected proximal the flow openings away from the flue and toward the side wall and the tank bottom of the water heater tank, thereby reducing an accumulation of scale on the side wall and the tank bottom.

BRIEF DESCRIPTION OF THE DRAWINGS

FIG. 3A is a front view of an exemplary embodiment of a cold water inlet including a proximal, intermediate, and distal conduit portion according to aspects of this invention;

FIG. 3B is a detail view of an embodiment of a flow opening and respective deflector in the distal conduit portion of the cold water inlet illustrated in FIG. 3A;

FIG. 3C is a proximal end view of the cold water inlet illustrated in FIG. 3A; and FIG. 3D is a flat view of the distal conduit portion of the cold water inlet illustrated in FIG. 3A showing deflector stagger.

DETAILED DESCRIPTION OF THE INVENTION

Figure 1:
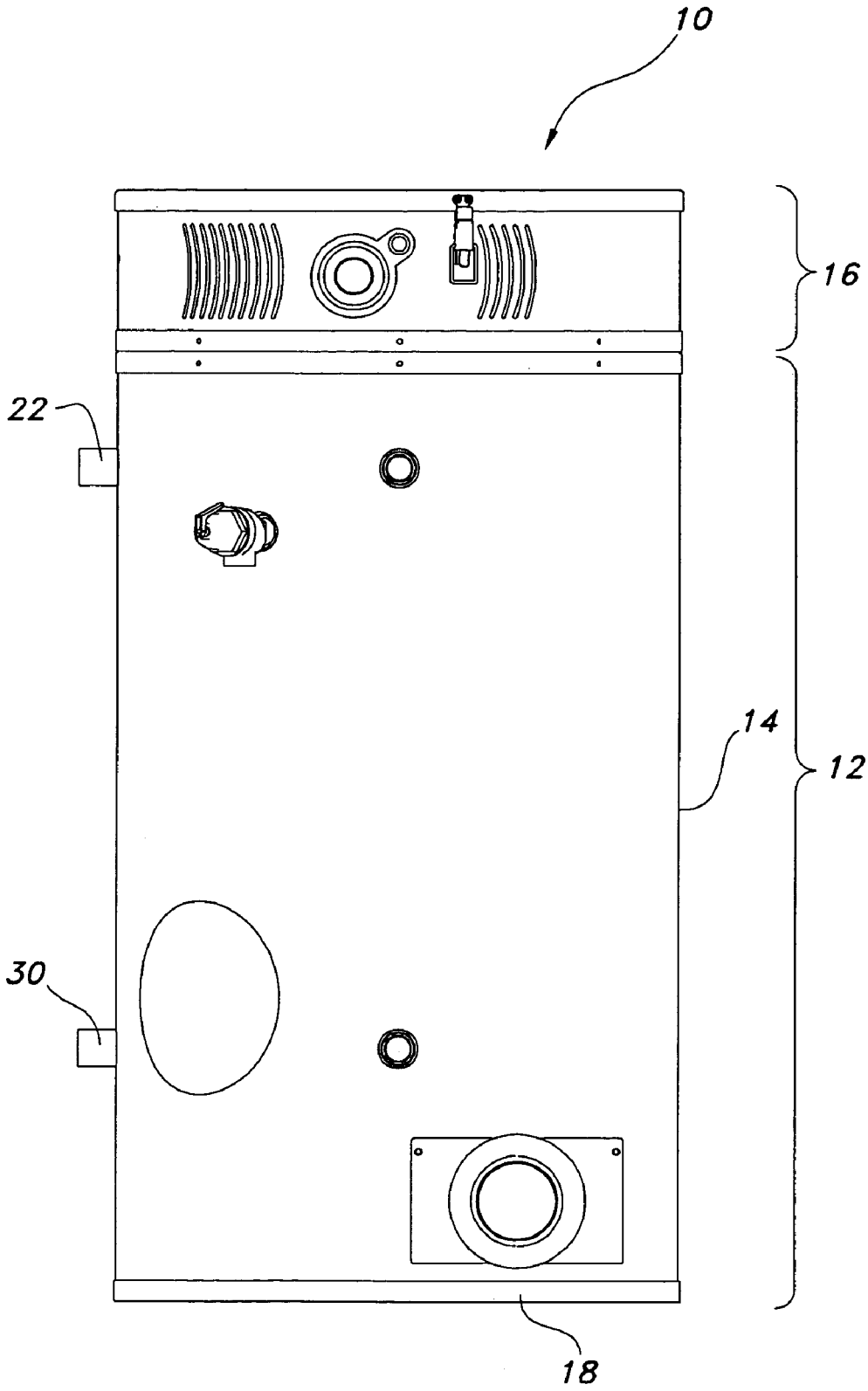
FIG. 1 is a front view of an exemplary embodiment of a water heater assembly having a cold water inlet according to aspects of this invention.

Although the invention is illustrated and described herein with reference to specific embodiments, the invention is not intended to be limited to the details shown. Rather, various modifications may be made in the details within the scope and range of equivalents of the claims and without departing from the invention.

Referring to the figures generally, an exemplary embodiment of a cold water inlet 30 for delivering water into a water tank 12 of a water heater 10 is provided. The water tank 12 has a side wall 14, a tank bottom 18, and at least one flue 20 extending upwardly through the water tank 12. The cold water inlet 30 includes an inlet conduit 32 configured to extend along a horizontal axis H through the side wall 14 of the water tank 12, into a bottom portion of the water tank 12, and toward the flue 20. The inlet conduit 32 includes a proximal conduit portion 34 defining a flow opening for water flow into the inlet conduit 32, an intermediate conduit portion 36 extending from the proximal conduit portion 34 and defining a flow passage for the water flow, and a distal conduit portion 38 extending from the intermediate portion 36 and terminating at a closed end 40 configured to reduce the amount of the water flow directed toward the flue 20. The cold water inlet 30 further includes flow openings 42 defined in the distal conduit portion 38 to permit the water flow to exit the inlet conduit 32. The flow openings 42 are spaced about a circumference of the inlet conduit 32, thereby eliminating the need to align the inlet conduit 32 with respect to the tank bottom 18. Deflectors 44 are positioned along the distal conduit portion 38 of the inlet conduit 32 proximal respective ones of the flow openings 42. The deflectors 44 are oriented to extend distally from the inlet conduit 32 and toward the horizontal axis H for deflecting the water flow. The closed end 40 and the deflectors 44 of the inlet conduit 32 coact, as the water flows into the water tank 12, to direct the water flow away from the flue 20 and toward the side wall 14 and tank bottom 18 of the water tank 12, thereby reducing an accumulation of scale on the side wall 14 and tank bottom 18.

In another exemplary embodiment, a water heater 10 is provided including a water tank 12 having a side wall 14 and a tank bottom 18, at least one flue 20 extending upwardly through an interior of the water tank 12, and a cold water inlet 30 coupled to the side wall 14 of the water tank 12 for delivering water into the water tank 12. The cold water inlet 30 includes an inlet conduit 32 extending along a horizontal axis H through the side wall 14 of the water tank 12, into a bottom portion of the water tank 12, and toward the flue 20. The inlet conduit 32 includes a proximal conduit portion 34 defining a flow opening for water flow into the inlet conduit 32, an intermediate conduit portion 36 extending from the proximal conduit portion 34 and defining a flow passage for the water flow, and a distal conduit portion 38 extending from the intermediate portion 36 and terminating at a closed end 40 configured to reduce the amount of the water flow directed toward the flue 20. The cold water inlet 30 further includes flow openings 42 defined in the distal conduit portion 38 to permit the water flow to exit the inlet conduit 32. The flow openings 42 are spaced about a circumference of the inlet conduit 32, thereby eliminating the need to align the inlet conduit 32 with respect to the tank bottom 18. Deflectors 44 are positioned along the distal conduit portion 38 of the inlet conduit 32 proximal respective ones of the flow openings 42. The deflectors 44 are oriented to extend distally from the inlet conduit 32 and toward the horizontal axis H for deflecting the water flow. The closed end 40 and the deflectors 44 of the inlet conduit 32 coact, as the water flows into the water tank 12, to direct the water flow away from the flue 20 and toward the side wall 14 and the tank bottom 18 of the water tank 12, thereby reducing an accumulation of scale on the side wall 14 and the tank bottom 18.

In yet another exemplary embodiment, a method is provided for delivering cold water into a water heater tank 12 having a side wall 14, a tank bottom 18, a cold water inlet 30, and at least one flue 20 extending upwardly through an interior of the water tank 12. The method delivers cold water into the water heater tank 12 while reducing the amount of water flow directed toward the flue 20, eliminating the need to align the cold water inlet 30 with respect to the tank bottom 18, and directing water flow toward the side wall 14 and the tank bottom 18 to reduce an accumulation of scale on the side wall 14 and the tank bottom 18. Water is delivered through an inlet conduit 32 along a horizontal axis H through the side wall 14 of the water tank 12, into a bottom portion of the water tank 12, and toward the flue 20. Water flow is substantially prevented from the inlet conduit 32 along the horizontal axis H toward the flue 20, thereby reducing the amount of water flow directed toward the flue 20. Water flow is delivered from the inlet conduit 32 through flow openings 42 defined in the inlet conduit 32 and spaced about a circumference of the inlet conduit 32, thereby eliminating the need to align the inlet conduit 32 with respect to the tank bottom 18. Water flow is deflected proximal the flow openings 42 away from the flue 20 and toward the side wall 14 and the tank bottom 18 of the water heater tank 12, thereby reducing an accumulation of scale on the side wall 14 and the tank bottom 18.

Figure 2A:
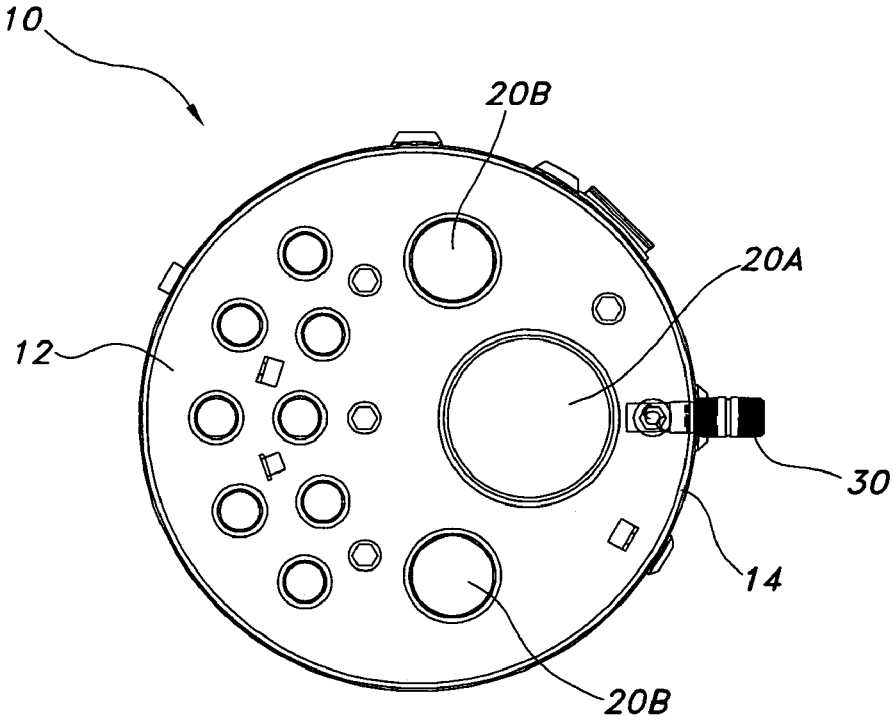
FIG. 2A is a top view of the water heater assembly illustrated in FIG. 1 showing a cold water inlet, a main flue, and two smaller flues.
Figure 2B:
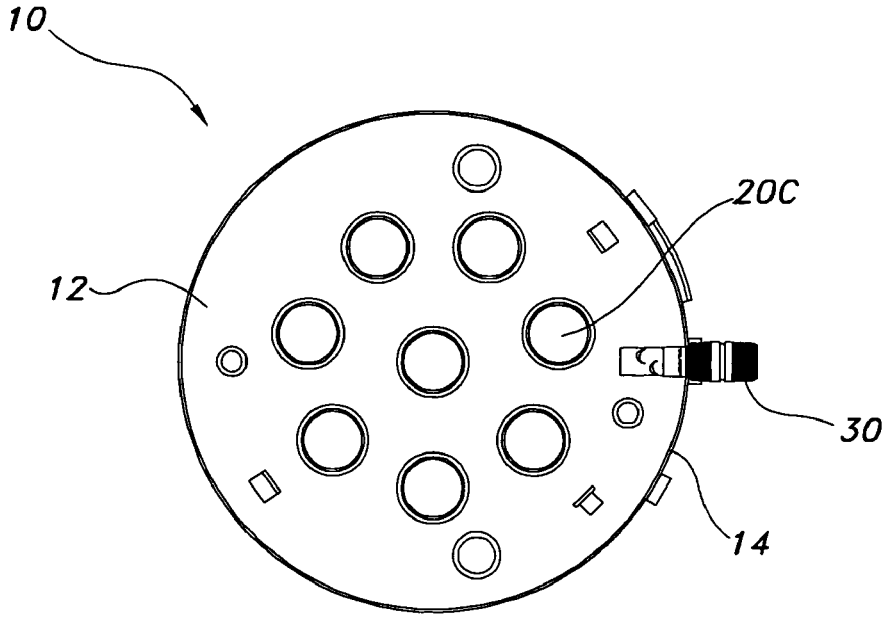
FIG. 2B is a top view of another exemplary embodiment of a water having a cold water inlet and eight flues.
Figure 2C:
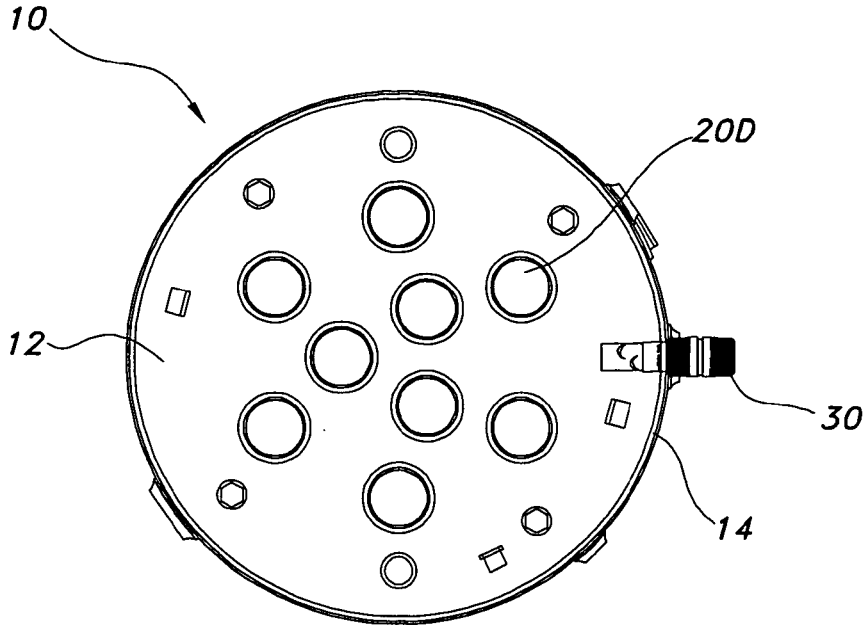
FIG. 2C is a top view of another exemplary embodiment of a water having a cold water inlet and nine flues.
Figure 2D:
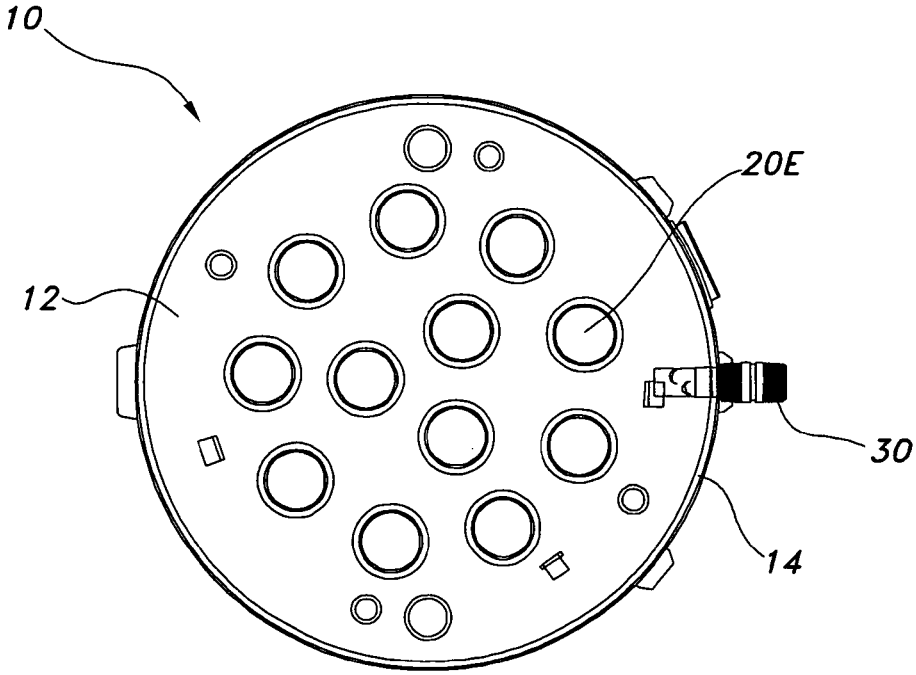
FIG. 2D is a top view of another exemplary embodiment of a water having a cold water inlet and twelve flues.
Figure 2E:
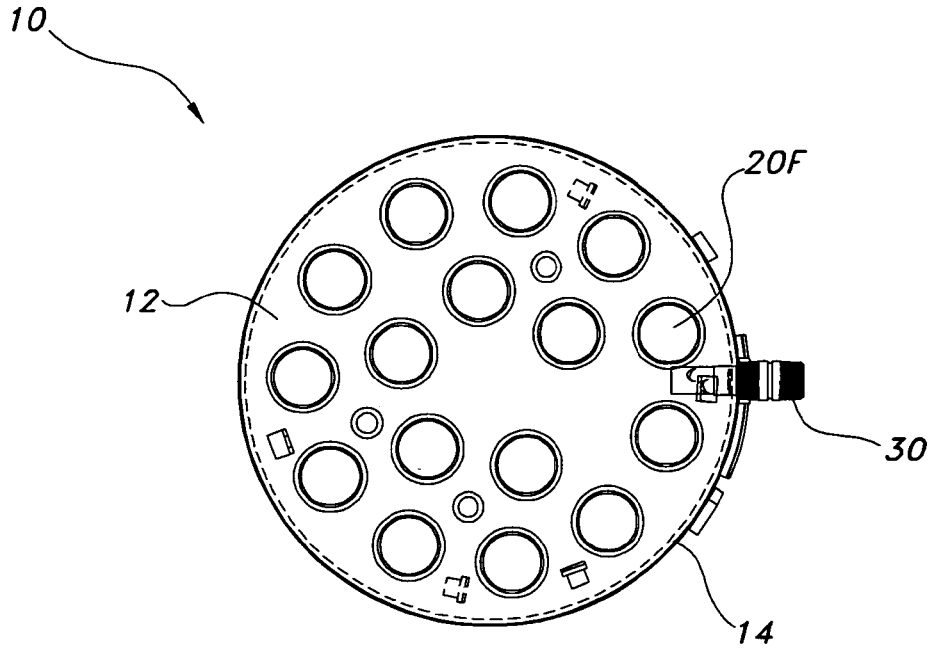
FIG. 2E is a top view of another exemplary embodiment of a water having a cold water inlet and sixteen flues.
Figure 2F:
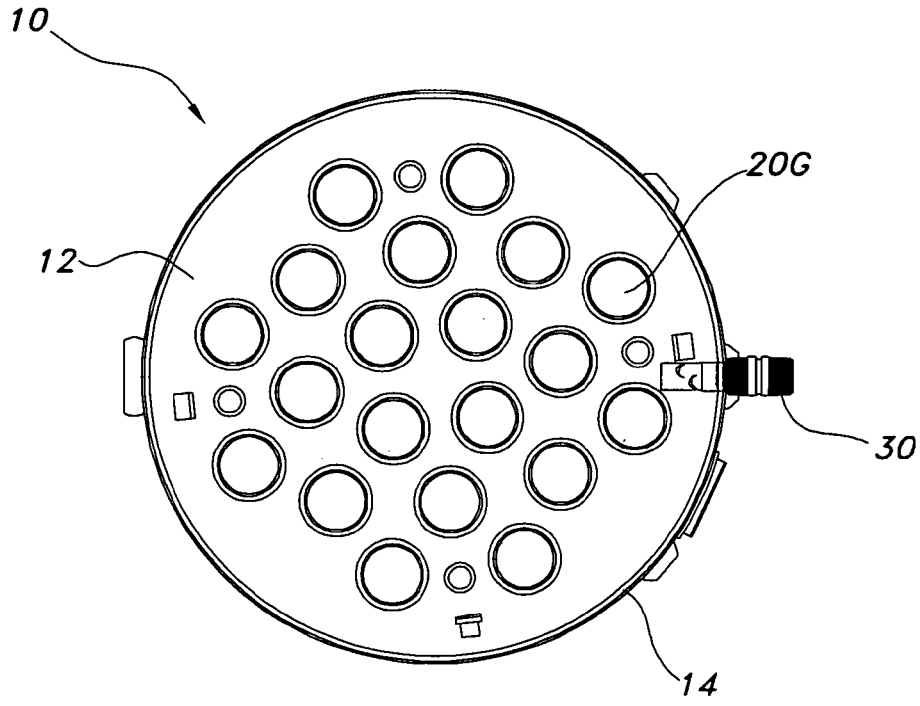
FIG. 2F is a top view of another exemplary embodiment of a water having a cold water inlet and twenty flues.

Referring now to FIG. 1, a water heater assembly embodying exemplary aspects of this invention is generally designated by the numeral "10." FIGS. 1–2F depict a commercial or residential water heater. However, the descriptions herein apply to commercial water heaters and residential or domestic water heaters, as well as other heat transfer systems.

The water heater assembly 10 includes a water tank 12 having a side wall 14, a head assembly 16, and a tank bottom 18. The head assembly 16 and the tank bottom 18 are welded to the top and bottom (respectively) of the side wall 14 of the water tank 12 with at least one flue 20 (shown in FIGS. 2A–2F) extending upwardly through the water tank 12 and welded into the head 16 and bottom 18 to form water tight seals for the containment of water within the water tank 12. The side wall 14 is configured to include a cold water inlet 30 and a hot water outlet 22.

A heat source such as gas or oil is combusted beneath the tank bottom 18 of the water tank 12 within a combustion chamber (not shown). At least one flue 20 (shown in FIGS. 2A–2F) extends from the tank bottom 18 through the head assembly 16 to exhaust combustion gases from the combustion chamber (not shown).

FIGS. 2A–2F are top views of the water heater assembly 10 illustrating the position of the cold water inlet 30 relative to various flue configurations within the water tank 12. As will be described in greater detail below, the closed end and the deflectors of the inlet conduit of the cold water inlet 30 coact, as the water flows into the water tank 12, to direct the water flow away from the flue 20 (or flues) and toward the side wall 14 and tank bottom of the water tank 12, thereby reducing an accumulation of scale on the side wall 14 and tank bottom 18.

Referring to FIGS. 2A–2F generally, the cold water inlet 30 extends along a horizontal axis through the side wall 14 of the water tank 12, into a bottom portion of the water tank 12, and toward the flues 20. FIG. 2A illustrates a water heater assembly 10 containing a main flue 20A and two smaller flues 20B. FIG. 2B illustrates a water heater assembly 10 containing eight flues 20C. FIG. 2C illustrates a water heater assembly 10 containing nine flues 20C. FIG. 2D illustrates a water heater assembly 10 containing a twelve flues 20E. FIG. 2E illustrates a water heater assembly 10 containing sixteen flues 20F. FIG. 2F illustrates a water heater assembly 10 containing twenty flues 20G.

The present invention is not limited to the flue configurations illustrated in the figures. The cold water inlet 30 may be utilized in a water heater assembly 10 containing any number of flues arranged in any number of configurations to suit a variety of applications.

Referring to FIG. 3A, the cold water inlet 30 includes an inlet conduit 32 configured to extend along a horizontal axis H through the side wall 14 of the water tank 12 (shown in FIG. 1), into a bottom portion of the water tank 12, and toward the flue or flues 20 (shown in FIGS. 2A–2F). The inlet conduit 32 includes a proximal conduit portion 34 defining a flow opening for water flow into the inlet conduit 32, an intermediate conduit portion 36 extending from the proximal conduit portion 32 and defining a flow passage for the water flow, and a distal conduit portion 38 extending from the intermediate portion 36 and terminating at a closed end 40 configured to reduce the amount of the water flow directed toward the flue 20. The inlet conduit 32 is substantially tubular with a substantially constant flow passage through the proximal portion 34. The intermediate portion 36 of the inlet conduit 32 extends substantially horizontally toward the interior region of the tank 12 upon installation of the cold water inlet 30 (as represented in FIGS. 2A–2F).

The cold water inlet 30 further includes flow openings 42 defined in the distal conduit portion 38 to permit the water flow to exit the inlet conduit 32. The flow openings 42 are spaced about a circumference of the inlet conduit 32 (described in greater detail below with reference to FIGS. 3C and 3D), thereby eliminating the need to align the inlet conduit 32 with respect to the tank bottom. Deflectors 44 are positioned along the distal conduit portion 38 of the inlet conduit 32 proximal respective ones of the flow openings 42. The deflectors 44 are oriented to extend distally from the inlet conduit 32 and toward the horizontal axis H for deflecting the water flow. The deflectors 44 include a surface 46 oriented at an angle A toward the horizontal axis H (described in greater detail below with reference to FIG. 3B). The deflectors 44 are spaced about a circumference of the distal conduit portion 38 of the inlet conduit 32 (described in greater detail below with reference to FIGS. 3C and 3D).

The inlet conduit 32 is made from stainless steel such as Type 304. However, the material of the inlet conduit 32 is not limited to Type 304, and may be made from other types of stainless steel, copper, or any other suitable conductive or metallic material.

A fitting 48 is positioned over the proximal conduit portion 34 of the inlet conduit 32 for forming a connection between the inlet conduit 32 and the side wall 14 of the tank 12 such that the inlet conduit 32 extends through the fitting 48.

The fitting 48 includes a radially inwardly extending surface or groove 50 for engaging the proximal conduit portion 34 of the inlet conduit 32 to prevent movement of the inlet conduit 32 with respect to the water tank 12 in a direction along the horizontal axis H, yet permitting rotation of the inlet conduit 32 with respect to the water tank 12 about the horizontal axis H.

The fitting 48 is made from stainless steel such as Type A53, zinc plated with chromate wash. However, the material of the fitting 48 is not limited to Type A53, and may be made from other types of stainless steel or any other suitable metallic or non-metallic material rigid enough to form the connection between the inlet conduit 32 and the side wall 14 of the tank 12.

A dielectric insulator 52 is positioned between the fitting 48 and the inlet conduit 32. The dielectric insulator 52 may consist of, for example, a polypropylene liner 52A and a polypropylene sleeve 52B. The polypropylene liner 52A and sleeve 52B together isolate the inlet conduit 32 from dielectrically conducting to the side wall 14 of the water tank 12.

FIG. 3B is a detail view of a flow opening 42 and respective deflector 44 in the distal conduit portion 38 of the inlet conduit 32. The deflectors 44 include a surface 46 oriented at an angle A toward the horizontal axis H (shown in FIG. 3A).

The angle A at which the surface 46 is oriented is typically 45°. Angle A, however, is not limited to 45°, and may be any other value suitable for a particular application. The horizontal distance B between the bottom edge of the flow opening 42 and the flow deflector 44 is typically 0.13-inch. The water flow clearance distance C between the bottom edge of the flow opening 42 and the flow deflector 44 is typically 0.22-inch. Distances B and C, however, are not limited to these values, and may be any other values suitable for a particular application.

FIG. 3C is a proximal end view of the cold water inlet 30. The flow openings 42 (not shown) and respective deflectors 44 are concentrically spaced about a circumference of the inlet conduit 32, thereby eliminating the need to align the inlet conduit 32 with respect to the tank bottom 18. More specifically, no special tool is required for final adjustment or alignment. The angle D at which the flow openings 42 (not shown) and respective deflectors 44 are concentrically spaced is typically 60°. Angle D, however, is not limited to 60°, and may be any other value suitable for a particular application.

FIG. 3D is a flat view of the distal conduit portion 38 of the inlet conduit 32. As illustrated, the flow openings 42 and respective deflectors 44 are staggered. The circumferential distance E between the flow openings 42 and respective deflectors 44 is typically 0.69-inch. The horizontal distance F between the flow openings 42 and respective deflectors 44 is typically 0.63-inch. Distances E and F, however, are not limited to these values, and may be any other values suitable for a particular application. The circumferential size of each flow opening 42 and respective deflector 44 is represented by dimensions G and I. Dimension G is typically 0.28-inch, and dimension I is typically 0.70-inch. Dimensions G and I, however, are not limited to these values, and may be any other values suitable for a particular application.

In use, cold water is delivered into the water heater tank 12 through the inlet conduit 32 along the horizontal axis H through the side wall 14 of the water tank 12, into a bottom portion of the water tank 12, and toward the flue(s) 20. Water flow is impinged against the closed end 40 of the inlet conduit 32 and is therefore substantially prevented from the inlet conduit 32 along the horizontal axis H toward the flue(s) 20, thereby reducing the amount of water flow directed toward the flue(s) 20. Water flow is delivered from the inlet conduit 32 through the flow openings 42 defined in the inlet conduit 32 and spaced about a circumference of the inlet conduit 32. Water flow is deflected proximal the flow openings 42 by passing water flow past the deflectors 44 positioned adjacent the flow openings 42. Consequentially, water flow is deflected away from the flue(s) 20 and toward the side wall 14 and the tank bottom 18 of the water heater tank 12, thereby reducing an accumulation of scale on the side wall 14 and the tank bottom 18.

In summary, the closed end 40 and the deflectors 44 of the inlet conduit 32 coact, as the water flows into the water tank 12, to direct the water flow away from the flue(s) 20 and toward the side wall 14 and tank bottom 18 of the water tank 12, thereby reducing an accumulation of scale on the side wall 14 and tank bottom 18.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A cold water inlet for delivering water into a water tank of a water heater, the water tank having a side wall, a tank bottom, and at least one flue extending upwardly through the water tank, said cold water inlet comprising:

an inlet conduit configured to extend along a horizontal axis through the side wall of the water tank, into a bottom portion of the water tank, and toward the flue, said inlet conduit comprising a proximal conduit portion defining a flow opening for water flow into said inlet conduit, an intermediate conduit portion extending from said proximal conduit portion and defining a flow passage for the water flow, and a distal conduit portion extending from said intermediate portion and terminating at a closed end configured to reduce the amount of the water flow directed toward the flue;

flow openings defined in said distal conduit portion to permit the water flow to exit said inlet conduit, said flow openings being spaced about a circumference of said inlet conduit, thereby eliminating the need to align said inlet conduit with respect to the tank bottom; and deflectors positioned along said distal conduit portion of said inlet conduit proximal respective ones of said flow openings, said deflectors being oriented to extend distally from said inlet conduit and toward said horizontal axis for deflecting the water flow, wherein said closed end and said deflectors of said inlet conduit coact, as the water flows into the water tank, to direct the water flow away from the flue and toward the side wall and tank bottom of the water tank, thereby reducing an accumulation of scale on the side wall and tank bottom.

2. The cold water inlet of claim 1, wherein said inlet conduit is substantially tubular with a substantially constant flow passage through said proximal portion.

3. The cold water inlet of claim 1, wherein said intermediate portion of said inlet conduit extends substantially horizontally toward said interior region of said tank upon installation of said cold water inlet.

4. The cold water inlet of claim 1, wherein at least some of said deflectors comprise a surface oriented at an angle toward said horizontal axis.

5. The cold water inlet of claim 1, wherein said deflectors are spaced about a circumference of said distal conduit portion of said inlet conduit.

6. The cold water inlet of claim 1 further comprising a fitting positioned over said proximal conduit portion of said inlet conduit for forming a connection between said inlet conduit and the side wall of the tank such that said inlet conduit extends through said fitting.

7. The cold water inlet of claim 6, wherein said fitting comprises means for engaging said proximal conduit portion of said inlet conduit to prevent movement of said inlet conduit in a direction along said horizontal axis yet permitting rotation of said inlet conduit about said horizontal axis.

8. The cold water inlet of claim 7, wherein said means for engaging comprises a radially inwardly extending surface positioned to engage an outer surface of said proximal conduit portion of said inlet conduit.

9. The cold water inlet of claim 6 further comprising a dielectric insulator positioned between said fitting and said inlet conduit.

10. The cold water inlet of claim 9, wherein said dielectric insulator is a polypropylene sleeve.

11. A water heater comprising:

a water tank having a side wall and a tank bottom;

at least one flue extending upwardly through an interior of said water tank; and a cold water inlet coupled to said side wall of said water tank for delivering water into said water tank, said cold water inlet comprising an inlet conduit extending along a horizontal axis through said side wall of said water tank, into a bottom portion of said water tank, and toward said flue, said inlet conduit comprising a proximal conduit portion defining a flow opening for water flow into said inlet conduit, an intermediate conduit portion extending from said proximal conduit portion and defining a flow passage for the water flow, and a distal conduit portion extending from said intermediate portion and terminating at a closed end configured to reduce the amount of the water flow directed toward said flue, flow openings defined in said distal conduit portion to permit the water flow to exit said inlet conduit, said flow openings being spaced about a circumference of said inlet conduit, thereby eliminating the need to align said inlet conduit with respect to said tank bottom, and deflectors positioned along said distal conduit portion of said inlet conduit proximal respective ones of said flow openings, said deflectors being oriented to extend distally from said inlet conduit and toward said horizontal axis for deflecting the water flow, wherein said closed end and said deflectors of said inlet conduit coact, as the water flows into said water tank, to direct the water flow away from said flue and toward said side wall and said tank bottom of said water tank, thereby reducing an accumulation of scale on said side wall and said tank bottom.

12. The water heater of claim 11, wherein said inlet conduit of said cold water inlet is substantially tubular with a substantially constant flow passage through said proximal portion.

13. The water heater of claim 11, wherein said intermediate portion of said inlet conduit of said cold water inlet extends substantially horizontally toward said interior region of said tank upon installation of said cold water inlet.

14. The water heater of claim 11, wherein at least some of said deflectors of said inlet conduit comprise a surface oriented at an angle toward said horizontal axis.

15. The water heater of claim 11, wherein said deflectors of said inlet conduit are spaced about a circumference of said distal conduit portion of said inlet conduit.

16. The water heater of claim 11 further comprising a fitting positioned over said proximal conduit portion of said inlet conduit for forming a connection between said inlet conduit and the side wall of the tank such that said inlet conduit extends through said fitting.

17. The water heater of claim 16, wherein said fitting comprises means for engaging said proximal conduit portion of said inlet conduit to prevent movement of said inlet conduit in a direction along said horizontal axis yet permitting rotation of said inlet conduit about said horizontal axis.

18. The water heater of claim 17, wherein said means for engaging comprises a radially inwardly extending surface positioned to engage an outer surface of said proximal conduit portion of said inlet conduit.

19. The water heater of claim 16 further comprising a dielectric insulator positioned between said fitting and said inlet conduit.

20. The water heater of claim 19, wherein said dielectric insulator is a polypropylene sleeve.

21. In a water heater tank having a side wall, a tank bottom, a cold water inlet, and at least one flue extending upwardly through an interior of the water tank, a method of delivering cold water into the water heater tank while reducing the amount of water flow directed toward the flue, eliminating the need to align the cold water inlet with respect to the tank bottom, and directing water flow toward the side wall and the tank bottom to reduce an accumulation of scale on the side wall and the tank bottom, said method comprising:

delivering water through an inlet conduit along a horizontal axis through the side wall of the water tank, into a bottom portion of the water tank, and toward the flue;

substantially preventing water flow from the inlet conduit along the horizontal axis toward the flue, thereby reducing the amount of water flow directed toward the flue;

delivering water flow from the inlet conduit through flow openings defined in the inlet conduit and spaced about a circumference of the inlet conduit, thereby eliminating the need to align the inlet conduit with respect to the tank bottom; and deflecting water flow proximal the flow openings away from the flue and toward the side wall and the tank bottom of the water heater tank, thereby reducing an accumulation of scale on the side wall and the tank bottom.

22. The method of claim 21, wherein said preventing step includes impinging water flow against a closed end of the inlet conduit.

23. The method of claim 21, wherein said deflecting step includes passing water flow past deflectors positioned adjacent the flow openings.

* * * * *